US007025066B2

(12) United States Patent
Lawson et al.

(10) Patent No.: US 7,025,066 B2
(45) Date of Patent: Apr. 11, 2006

(54) METHOD OF REDUCING THE SUCROSE ESTER CONCENTRATION OF A TOBACCO MIXTURE

(76) Inventors: Jerry Wayne Lawson, 4500 River Ridge Rd., Pfafftown, NC (US) 27040; William Monroe Coleman, III, 2900 Loch Dr., Winston-Salem, NC (US) 27106; Ronald Lewis Parks, 5100 Cobblestone Rd., Winston-Salem, NC (US) 27106; William Samuel Simmons, 351 Staffordshire Rd., Winston-Salem, NC (US) 27104

( * ) Notice: Subject to any disclaimer, the term of this patent is extended or adjusted under 35 U.S.C. 154(b) by 0 days.

(21) Appl. No.: 10/285,395

(22) Filed: Oct. 31, 2002

(65) Prior Publication Data

US 2004/0084056 A1 May 6, 2004

(51) Int. Cl.
*A24B 15/22* (2006.01)

(52) U.S. Cl. ..... 131/299; 131/290

(58) Field of Classification Search ..... 131/296, 131/290, 300, 299, 276, 275, 294, 295, 278
See application file for complete search history.

(56) References Cited

U.S. PATENT DOCUMENTS

| | | | | |
|---|---|---|---|---|
| 3,345,992 | A | 10/1967 | Lederman et al. | |
| 3,357,436 | A * | 12/1967 | Wright | 131/135 |
| 3,386,448 | A | 6/1968 | Wochnowski | |
| 3,424,171 | A | 1/1969 | Rooker | |
| 3,429,317 | A | 2/1969 | Koch et al. | |
| 3,828,798 | A | 8/1974 | Harper et al. | |
| 4,040,431 | A | 8/1977 | Ashworth et al. | |
| 4,091,823 | A | 5/1978 | Kallianos et al. | |
| 4,150,677 | A | 4/1979 | Osborne, Jr. et al. | |
| 4,298,012 | A | 11/1981 | Wochnowski | |
| 4,340,073 | A | 7/1982 | de la Burde et al. | |
| 4,506,682 | A | 3/1985 | Muller | |
| 4,537,204 | A | 8/1985 | Gaisch et al. | |
| 4,566,468 | A | 1/1986 | Sachleben et al. | |
| 4,596,259 | A | 6/1986 | White et al. | |
| 4,605,016 | A | 8/1986 | Soga et al. | |
| 4,607,646 | A | 8/1986 | Lilly, Jr. et al. | |
| 4,638,816 | A | 1/1987 | Cox et al. | |
| 4,640,299 | A | 2/1987 | Ono et al. | |
| 4,687,007 | A * | 8/1987 | Denier et al. | 131/296 |
| 4,744,375 | A | 5/1988 | Denier et al. | |
| 4,760,854 | A | 8/1988 | Jewell et al. | |
| 4,887,619 | A | 12/1989 | Burcham, Jr. et al. | |
| 4,941,484 | A | 7/1990 | Clapp et al. | |
| 4,986,286 | A | 1/1991 | Roberts et al. | |
| 5,016,654 | A | 5/1991 | Bernasek et al. | |
| 5,022,416 | A | 6/1991 | Watson | |
| 5,038,802 | A * | 8/1991 | White et al. | 131/297 |
| 5,060,669 | A | 10/1991 | White et al. | |
| 5,099,862 | A | 3/1992 | White et al. | |
| 5,103,842 | A | 4/1992 | Strang et al. | |
| 5,117,844 | A | 6/1992 | Spicer | |
| 5,121,757 | A | 6/1992 | White et al. | |
| 5,131,415 | A | 7/1992 | Munoz et al. | |
| 5,159,942 | A | 11/1992 | Brinkley et al. | |
| 5,234,008 | A | 8/1993 | Fagg | |
| 5,235,992 | A | 8/1993 | Sensabaugh, Jr. | |
| 5,259,403 | A | 11/1993 | Guy et al. | |
| 5,318,050 | A | 6/1994 | Gonzalez-Parra et al. | |
| 5,383,479 | A | 1/1995 | Winterson et al. | |
| 5,908,032 | A | 6/1999 | Poindexter et al. | |
| 6,298,858 | B1 * | 10/2001 | Coleman, III et al. | 131/290 |

FOREIGN PATENT DOCUMENTS

| | | |
|---|---|---|
| EP | 0 517 407 A2 | 12/1992 |
| EP | 0 821 886 A2 | 2/1998 |
| WO | WO 97/04673 A1 | 2/1997 |

OTHER PUBLICATIONS

John C. Leffingwell, Ph.D., "Chemical Constituents of Tobacco Leaf and Differences Among Tobacco Types", Leffingwell Reports, vol. 1 (No. 2), Feb., 2001, pp. 1-56.*
Arrendale et al., "Characterization of the Sucrose Ester Fraction from *Nicotiana glutinosa*", *J. Agric. Food Chem.*, 1990, pp. 75-85, vol. 38, No. 1.
Arrendale et al., "Isolation and Identification of the Wax Esters from the Cuticular Waxes of Green Tobacco Leaf", *Beiträge zur Tabakforschung International*, 1988, pp. 67-84, vol. 14, No. 2.

(Continued)

*Primary Examiner*—Dionne Walls Mayes
(74) *Attorney, Agent, or Firm*—Alston & Bird LLP

(57) ABSTRACT

The flavor and aroma characteristics of the smoke of a tobacco blend incorporating Oriental tobacco are improved by subjecting that blend to heat treatment. Oriental tobacco having a relatively high sucrose ester content is combined with a second dissimilar Oriental tobacco material and/or a non-Oriental tobacco material to form a tobacco mixture, and that mixture is heated for a time and under conditions sufficient to reduce the concentration of sucrose esters in the Oriental tobacco. Tobacco blends having reduced levels of sucrose esters yield smoke that does not possess undesirable off-notes provided by pyrolysis products of those sucrose esters; namely, 2-methylpropionic acid, 3-methylbutyric acid and 3-methylpentanoic acid.

27 Claims, No Drawings

OTHER PUBLICATIONS

Danehower, David A., "A Rapid Method for the Isolation and Quantification of the Sucrose Esters of Tobacco", *Tob. Intl.*, 1987, pp. 30-33, vol. 189, No. 8.

Einolf et al., "Estimation of Sucrose Esters in Tobacco by Direct Chemical Ionization Mass Spectrometry", *J. Agric. Food Chem.*, 1984, pp. 785-789, vol. 32, No. 4.

Kandra et al., "Chlorsulfuron Modifies Biosynthesis of Acyl Substituents of Sucrose Esters Secreted by Tobacco Trichomes", *Plant Physiol.*, 1990, pp. 906-912, vol. 94.

Kandra et al., "Modified branched-chain amino acid pathways give rise to acyl acids of sucrose esters exuded from tobacco leaf trichomes", *Eur. J. Biochem.*, 1990, pp. 385-391, vol. 188.

Lin et al., "Rapid and Simple Method for Estimation of Sugar Esters", *J. Agric. Food Chem.*, 1994, pp. 1709-1712, vol. 42, No. 8.

Schlotzhauer et al., "The Contribution of Sucrose Esters to Tobacco Smoke Composition", 1986, pp. 229-238, vol. 13, No. 5.

The et al., "Arabinoxylan-Lipids-Based Edible Films and Coatings. 2. Influence of Sucroester Nature on the Emulsion Structure and Film Properties", *J. Agric. Food Chem.*, 2002, pp. 266-272, vol. 50, No. 2.

* cited by examiner

METHOD OF REDUCING THE SUCROSE ESTER CONCENTRATION OF A TOBACCO MIXTURE

FIELD OF THE INVENTION

The invention relates to tobacco, and in particular, to methods for processing tobacco blends suitable for use in manufacturing smoking articles.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in a so-called "blended" form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, *Tobacco Encyclopedia*, Voges (Ed.) p. 44–45 (1984), Browne, *The Design of Cigarettes*, 3rd Ed., p.43 (1990) and *Tobacco Production, Chemistry and Technology*, Davis et al. (Eds.) p. 346 (1999).

Oriental tobaccos are desirable components of the tobacco blends of smoking products because Oriental tobaccos yield smoke possessing certain unique and desirable flavor and aroma characteristics. Most Oriental tobaccos possess relatively low nicotine content, and possess relatively high levels of certain reducing sugars, acids and volatile flavor compounds. Some of the distinct flavors and aromas characteristic of Oriental tobacco smoke are attributed to the presence of sucrose esters in Oriental tobaccos, and the pyrolysis products of those sucrose esters. The sucrose ester concentrations in some types of Oriental tobaccos are relatively high, and those sucrose esters are precursors to compounds that introduce so-called "off-notes" to the flavor and aroma of smoke that results from the burning of those tobaccos. Thus, there have been constraints upon the amount of certain Oriental tobaccos traditionally used in tobacco blends, because the desirable flavor and aroma characteristics of the smoke of those tobaccos become overpowering and undesirable when relatively high levels of those tobaccos are used in tobacco blends.

The types of sucrose esters that are present in Oriental tobaccos are sugar derivatives possessing covalently bound carboxylic acid groups. Sucrose esters typically present in Oriental tobaccos include those that can be represented by the following formula:

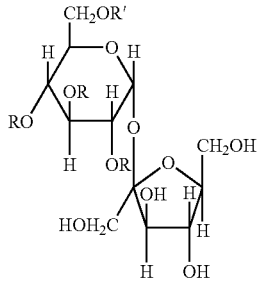

where R is $C_3$–$C_8$ carboxylate and R' is acetate. See, also, *Tobacco Production, Chemistry and Technology*, Davis et al. (Eds.) p. 294 (1999). Sucrose esters thermally decompose (e.g., such as when the Oriental tobacco incorporating those sucrose esters is burned) to yield branched chain low molecular weight carboxylic acids, including 2-methylpropionic acid, 3-methylbutyric acid and 3-methylpentanoic acid. Many of the off-notes characteristic of the smoke of Oriental tobaccos (e.g., those that are characterized as being "cheesy" or likening "sweaty sock" in nature) are associated with those carboxylic acids.

It would be desirable to provide a method for altering the sucrose ester concentration within a tobacco blend incorporating an Oriental tobacco. In particular, it would be desirable to provide tobacco blends incorporating Oriental tobaccos that when burned, such as during the use of smoking articles incorporating those blends, would provide optimized flavor and aroma characteristics associated with the pyrolysis products of sucrose esters.

SUMMARY OF THE INVENTION

The present invention relates to a method of altering the flavor and aroma characteristics of the smoke of a tobacco mixture incorporating Oriental tobacco. That method involves subjecting a moist mixture of tobaccos (e.g., a blend of tobaccos) to the application of heat. The mixture of tobaccos includes a first Oriental tobacco material, and in particular, an Oriental tobacco having a relatively high sugar ester content, with a second dissimilar Oriental tobacco having a relatively low sugar ester content and/or at least one non-Oriental tobacco, such as flue-cured tobacco, burley tobacco and/or Maryland tobacco. Surprisingly, it has been discovered that heat-treating such a moist tobacco blend for an effective period of time reduces the concentration of sugar esters in that blend, particularly sucrose ester concentration within the Oriental tobacco, thereby reducing off-note in the aroma and flavor of the smoke generated during the burning of that tobacco blend, such as when that tobacco blend is used for the manufacture of smoking articles such as cigarettes. As a result of the present invention, greater amounts of tobaccos having relatively high sugar ester concentrations can be used for providing the tobacco blends for smoking articles. Since the method of the invention only involves the use of moist tobacco and heat to accomplish the desired sucrose ester content reduction, the treated tobacco material can be stored for relatively long periods of time under conventional storage conditions and remain relatively chemically stable without undergoing significant unexpected chemical change. That is, the overall chemical nature (and hence the flavor and aroma characteristics) of the treated tobacco blend does not undergo unusual or undesirable changes during storage.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art.

The Oriental tobacco used in the invention can vary. Descriptions of Oriental-type tobaccos, growing practices, harvesting practices and curing practices are set forth in Wolf, *Aromatic or Oriental Tobaccos* (1962), Akehurst, *Tobacco* (1968), *Tobacco Encyclopedia*, Voges (Ed.) (1984), *Tobacco Production, Chemistry and Technology*, Davis et al. (Eds.) (1999). Oriental-type tobaccos also are referred to as Greek, aromatic and Turkish tobaccos. Representative Oriental-type tobaccos include the Izmir, Basma, Mavra and Samsun varieties. Other representative Oriental-type tobaccos include Trabzon, Thesalian, Tasova, Sinop, Izmit, Hendek, Edirne, Semdinli, Adiyanman, Yayladag, Iskenderun, Duzce, Macedonian, Katerini, Prilep, Krumovgrad, Bafra, Bursa, Bucak, Bitlis and Balikesir tobaccos, as well as the so-called semi-Oriental tobaccos such as Sebinkarahisar, Borgka and East Balkan tobaccos. Although Oriental-type tobaccos that are employed in accordance with the present invention can be grown in a variety of locations throughout the world, typical Oriental tobaccos are grown in eastern Mediterranean regions such as Turkey, Greece, Bulgaria, Macedonia, Syria, Lebanon, Italy, Yugoslavia, and Romania. Preferred Oriental tobaccos are sun cured. Preferred sun cured Oriental tobaccos are aged for at least one year after curing is complete.

Oriental-type tobaccos that are used in carrying out the present invention possess relatively high levels of sugar esters. The sugar esters present in those tobaccos typically are sucrose esters that possess relatively high levels of acid substituents comprised of 2-methylpropionic, 3-methylbutyric, and 3-methylpentanoic acid groups. Although the level of sucrose esters in Oriental tobaccos can vary considerably from growing region to growing region, and even within growing regions, Oriental tobacco material used in carrying out the method of the invention typically exhibits a sucrose ester concentration (expressed as methyl ester equivalents) of at least about 1,600 ppm, usually at least about 2,000 ppm, often at least about 3,000 ppm, frequently at least about 4,000, or even at least about 5,000 ppm, based on the dry weight of that Oriental tobacco.

A distinct or dissimilar Oriental tobacco variety or non-Oriental tobacco material can be blended or mixed with the first Oriental tobacco material to form the tobacco mixture. By "distinct or dissimilar Oriental tobacco variety" is meant an Oriental tobacco variety that is not genetically and chemically identical to the first Oriental tobacco material. An exemplary blend of two dissimilar Oriental tobacco varieties is a combination of any two of the Izmir, Basma and Samsun Oriental tobacco varieties. However, when two or more Oriental-type tobaccos are mixed together for purposes of carrying out the process of the present invention, it is most preferable that the sugar ester content of at least one of the Oriental tobaccos be considerably less than the other Oriental tobaccos in the blend or mixture. It is preferred that an Oriental-type tobacco having a relatively high sugar ester content be mixed with another type of tobacco, such as flue-cured tobacco, a burley tobacco, or a combination thereof. Other tobaccos that can be used in carrying out the present invention, preferably in combination with flue-cured and/or burley tobaccos, include, but are not limited to, tobaccos such as Maryland, dark, dark-fired and Rustica tobaccos, as well as other rare or specialty tobaccos, or blends thereof. See, for example, Akehurst, *Tobacco* (1968) and Tso, *Production, Physiology, and Biochemistry of Tobacco Plant* (1990).

The type of burley tobacco can vary. Descriptions of burley tobaccos, growing practices, harvesting practices and curing practices are set forth in Wiemik et al, *Rec. Adv. Tob. Sci.*, Vol. 21, p. 39–80 (1995), *Tobacco Production, Chemistry and Technology*, Davis et al. (Eds.) (1999) and *Burley Tobacco Information*, NC Coop. Ext. Serv. (2002). Representative burley tobaccos include Clay 402, Clay 403, Clay 502, Ky 14, Ky 907, Ky 910, Ky 8959, NC 2, NC 3, NC 4, NC 5, NC 2000, Tn 86, Tn 90, Tn 97, R 610, R 630, R 711, R 712, NCBH 129, Bu 21×Ky 10, HB04P, Ky 14×L 8, Kt 200, Newton 98, Pedigo 561, Pf561 and Va 509. Preferred burley tobaccos are air cured. Preferred air cured burley tobaccos are aged for at least one year after curing is complete. Preferred cured and aged burley tobaccos that are used in accordance with the present invention possess relatively low levels of sugar esters (i.e., much less than 0.1 percent sugar esters, based on the dry weight of that tobacco), and normally are virtually absent of sugar esters.

The type of flue-cured tobacco can vary. Descriptions of flue-cured tobaccos, growing practices, harvesting practices and curing practices are set forth in Hawks, *Principles of Flue-Cured Tobacco Production* (1978), Sumner et al., *Guidelines for Temperature, Humidity, and Airflow Control in Tobacco Curing*, Univ. Georgia Res. Bull. 299 (1983), Todd, *Flue-Cured Tobacco—Producing a Healthy Crop* (1981), *Tobacco Production, Chemistry and Technology*, Davis et al. (Eds.) (1999), *Flue-Cured Tobacco Information*, NC Coop. Ext. Serv. (2002) and US Pat. App. Pub. 2001/0000386 to Peele. Flue-cured tobaccos are also referred to as Virginia, bright or blond tobaccos. Representative flue-cured tobaccos include Coker 48, Coker 176, Coker 371-Gold, Coker 319, Coker 347, GL 939, K 149, K 326, K 340, K 346, K 358, K 394, K 399, K 730, NC 27NF, NC 37NF, NC 55, NC 60, NC 71, NC 72, NC 82, NC 95, NC 297, NC 606, NC 729, NC 2326, McNair 373, McNair 944, Ox 207, Ox 414 NF, Reams 126, Reams 713, Reams 744, RG 8, RG 11, RG 13, RG 17, RG 22, RG 81, RG H4, RG H51, Speight H-20, Speight G-28, Speight G-58, Speight G-70, Speight G-108, Speight G-111, Speight G-117, Speight 168, Speight 179, Speight NF-3, Va 116 and Va 182. Preferred flue-cured tobaccos are those that are cured using the types of techniques and conditions set forth in US Pat. App. Pub. 2001/0000386 to Peele. Preferred flue-cured tobaccos are aged for at least one year after curing is complete. Preferred cured and aged flue-cured tobaccos that are used in accordance with the present invention possess relatively low levels of sugar esters, and normally are virtually absent of sugar esters.

The type of Maryland tobacco can vary. Descriptions of Maryland tobaccos, growing practices, harvesting practices and curing practices are set forth in *Tobacco Encyclopedia*, Voges (Ed.) (1984), Aycock et al., Maryland Coop. Ext. (1984), Aycock et al., Maryland Coop. Ext. (1995), and *Tobacco Production, Chemistry and Technology*, Davis et al. (Eds.) (1999). Representative Maryland tobaccos include Md 10, Md 40, Md 201, Md 609, Md 872 and Md 341. Preferred Maryland tobaccos are air cured, and often are referred to as light air cured tobaccos. Preferred air cured Maryland tobaccos are aged for at least one year after curing is complete. Preferred cured and aged Maryland tobaccos that are used in accordance with the present invention possess relatively low levels of sugar esters, and normally are virtually absent of sugar esters.

The physical form of the tobacco materials used in the invention can vary. Most preferably, the tobaccos are those that have been appropriately cured and aged. Most preferably, the tobaccos are used in forms, and in manners, that are traditional for the blending of tobaccos for use as cut filler for the manufacture of smoking articles, such as cigarettes. The tobacco can be used in whole leaf form. Typically, Oriental-type tobaccos are used in whole leaf form. The tobacco also can be used in the form of laminae or strip, particularly when the tobacco is of a flue-cured, burley or Maryland variety. The tobacco also can have a shredded or cut filler form. Portions of the tobacco can have a processed form, such as processed tobacco stems (e.g., cut-rolled or cut-puffed stems), volume expanded tobacco (e.g., puffed tobacco, such as dry ice expanded tobacco (DIET), preferably in cut filler form), or reconstituted tobacco (e.g., reconstituted tobaccos manufactured using paper-making type or cast sheet type processes, preferably in strip or cut filler form). Though less preferred, Oriental-type tobaccos also can be combined with tobacco waste materials, such as fines, dust, scrap and stem.

The tobacco materials used in carrying out the process steps of the present invention are contacted with one another. The manner of contact can vary, and typically is such that moist tobacco tobaccos can be subjected to contact with one another in the presence of heat, or tobaccos can be subjected to contact with one another in the presence of heat and moisture. Typically, the tobacco materials are blended or mixed in equipment and methods known in the art of tobacco processing and blending, so as to provide a tobacco mixture. For example, the tobacco materials can be mixed in ovens, heated tanks or cylinders, bulkers, rotary dryers, tunnel dryers, fluidized bed dryers, belt or apron dryers, suspension dryers, and the like. Those types of equipment traditionally have been used for the casing, conditioning, reordering, bulking and drying of tobaccos during the preparation of those tobaccos for use in the formulation of tobacco blends for cigarette manufacture. Most preferably, those types of equipment provide convection heating of the tobacco material. See, for example, U.S. Pat. No. 3,345,992 to Lederman et al.; U.S. Pat. No. 3,357,436 to Wright; U.S. Pat. No. 3,386,448 to Wochnowski; U.S. Pat. No. 3,429,317 to Koch et al.; U.S. Pat. No. 4,640,299 to Ono et al.; U.S. Pat. No. 4,887,619 to Burcham et al.; U.S. Pat. No. 5,022,416 to Watson; U.S. Pat. No. 5,103,842 to Strang et al.; U.S. Pat. No. 5,117,844 to Spicer; and U.S. Pat. No. 5,383,479 to Winterson et al. Exemplary dryers designed for use in processing tobacco materials within the tobacco industry are commercially available from Hauni and Sargent. Tobaccos also can be contacted in streams of heated steam and air, for example, using the types of methods and equipment set forth in U.S. Pat. No. 4,298,012 to Wochnowski; U.S. Pat. No. 4,340,073 to de la Burde et al.; U.S. Pat. No. 5,259,403 to Guy et al.; and U.S. Pat. No. 5,908,032 to Poindexter et al. The method of blending preferably brings the two or more dissimilar types of tobacco materials into intimate contact. Preferably, the blending method provides a somewhat uniform physical mixing or blending of the components into a relatively homogenous physical blend. During contact with one another, the various types of tobacco materials can be subjected to movement, allowed to remain in,a somewhat stationary state, subjected to some physical compression or compaction, or subjected to some combination of the foregoing.

Although the relative amounts of each tobacco type may vary, it is preferable for the blend to include at least about 10 percent, more preferably at least about 20 percent, Oriental tobacco, by weight of that blend. The amount of Oriental tobacco present in the tobacco mixture can depend upon factors such as the desired final sucrose ester concentration of the tobacco mixture after heat treatment, the sucrose ester concentration of the untreated Oriental tobacco, the type of other tobacco materials in the blend, and the desired heat treatment conditions (e.g., temperature to which the tobacco blend is exposed, moisture level of the mixture, and treatment time of the blend). Thus, for example, a tobacco blend possessing an Oriental tobacco having a very high sugar ester content (i.e., a sugar ester content in the general range of about 6,000 ppm to about 7,000 ppm, based on the dry weight of that Oriental tobacco) typically possesses a relatively low amount of that type of Oriental tobacco. The other components of the blend typically comprise at least about 60 percent of the weight of that blend. In some embodiments, two or more suitable Oriental tobacco components comprise substantially all of the tobacco blend. However, for blends of at least one type of Oriental tobacco with at least one other dissimilar type of tobacco, the Oriental tobacco component of the blend of ranges from about 10 percent to about 90 percent, and preferably ranges from about 10 percent to about 30 percent, by weight of that blend; while the dissimilar tobacco component of that blend ranges from about 10 percent to about 90 percent, and preferably ranges from about 70 percent to about 90 percent, by weight of that blend.

It is preferable for the tobacco mixture to comprise flue-cured tobacco, burley tobacco, or a combination thereof. In one preferred embodiment, both flue-cured tobacco and burley tobacco are blended with the Oriental tobacco. In such an embodiment, the resulting tobacco mixture preferably comprises about 5 percent to about 75 percent, more preferably about 35 percent to about 50 percent, by weight of flue-cured tobacco; about 5 percent to about 75 percent, more preferably about 10 percent to about 50 percent, by weight of burley tobacco; and about 5 percent to about 40 percent, more preferably about 10 percent to about 30 percent, by weight of Oriental tobacco.

The present invention involves contacting an Oriental tobacco material with a second dissimilar Oriental tobacco material or a non-Oriental tobacco material to form a physical mixture of those tobacco types, and heating the resulting tobacco mixture for a time and under conditions sufficient to reduce the concentration of sucrose esters in the Oriental tobacco (and hence, overall within that mixture or blend of tobaccos). As such, the concentration of sugar esters naturally present within the Oriental tobacco can be decreased by more about 20 percent, and even by more than about 30 percent, by weight, based on the initial sugar ester content of that Oriental tobacco so treated. Typically, the process of the present invention can be employed to reduce the sugar ester content or concentration of the Oriental tobacco so treated to below about 1,500 ppm, and often below about 1,200 ppm, based on the dry weight of that Oriental tobacco material.

Although high levels of sucrose esters are known to cause unpleasant flavors in tobacco smoke at undesirably high levels, it is desirable to maintain the sucrose levels at a certain minimum level in order to prevent disruption of the distinctive overall aroma and flavor of Oriental tobacco. That is, the present invention can be employed to lower the natural sucrose ester concentration of a tobacco blend without totally eliminating the presence of sucrose esters within that blend. Typically, certain Oriental tobaccos that are processed in accordance with the present invention exhibit final sucrose ester levels, after treatment, of at least about 100 ppm, usually at least about 400 ppm, and often at least about 600 ppm; and frequently, the final sucrose ester levels in those tobaccos can range from about 1,000 ppm to about 1,500 ppm. The process of the present invention also can provide some reduction in the concentration of certain terpenes within the Oriental tobacco; and as such, certain Oriental tobaccos treated in appropriate manners can experience a reduction in the levels of megastigmatrienones, solanone, duvantriendiols and sclareolide within those tobaccos.

The mixture of tobacco that is heat-treated is moist. The tobacco blend or mixture typically possesses a moisture content, prior to treatment in accordance with the present invention, of at least about 15 percent, usually at least about 20 percent, and often at least about 25 percent, based on the total weight of the tobacco mixture. The tobacco blend or mixture typically possesses a moisture content, prior to treatment in accordance with the present invention, of up to about 50 weight percent, usually up to about 45 weight percent, and often up to about 40 weight percent. The tobacco blend or mixture often possesses a moisture content, prior to treatment in accordance with the present invention, of between about 30 weight percent and about 35 weight percent.

The method for achieving the desired moisture content in the various tobacco materials used in carrying out the present invention can vary. For example, an aqueous liquid, such as water, can be sprayed on, and subsequently absorbed by the tobacco materials. Alternatively, the tobacco materials can also be dipped into the liquid to absorb the desired amount of moisture. The moisture content can also be reached by spreading onto the tobacco materials casing solution or top dressing solution, or other liquids such as buffers, solvents, or solutions containing materials extraneous to natural tobacco materials. Manners and methods for moistening tobacco materials and blends of tobacco materials will be readily apparent to those skilled in the art of tobacco processing.

The various blend components can be moistened individually prior to blending, and/or the blend can be moistened. That is, blends of tobacco materials of desired moisture contents can be achieved by adjusting the moisture levels of each tobacco material prior to mixing and/or by modifying the moisture level after the tobacco components are contacted with one another. In one embodiment, each tobacco component of the ultimate tobacco mixture can have a different moisture content within a range of about 15 percent to about 50 percent by weight, such that the tobacco blend can have a final moisture level within the desired moisture range. That is, one tobacco component can have a relatively low moisture level prior to mixing, and another can have a relatively high moisture level prior to mixing. Blending of the two tobaccos would is expected to form a blend having an intermediate moisture level.

If desired, in addition to the aforementioned tobacco materials, the tobacco blend of the present invention can further include other components. However, no additional reagents or additives are required to reduce the sugar ester concentration of the tobacco blends incorporating Oriental tobaccos otherwise having relatively high natural sugar ester contents. Other components include casing materials (e.g., sugars, glycerine, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

Following the blending step and any necessary moisture adjustment steps, the tobacco blend is preferably allowed to stay in intimate contact for a period of time in order to equilibrate prior to heating. The actual time will vary, but is preferably between about 5 minutes to about 24 hours. Typically, the tobacco blend is allowed to stand for about 5 to about 30 minutes.

The tobaccos that have been contacted are exposed to heat. The tobacco mixture should be heated at a temperature sufficiently high to reduce the sucrose ester content, but low enough to avoid the formation of components that are deleterious to the taste characteristics of the tobacco composition. The temperature of the heat treatment is generally at least about 200° F. A preferred range is about 200° F. to about 310° F., more preferably about 200° F. to about 250° F. Although it is possible to expose the tobacco materials to heated gases or atmospheres of high temperatures (e.g., temperatures in excess of 400° F.), it is desirable that such exposure be carried out for a relatively short period of time, in order that the tobacco material itself not be exposed to temperatures much in excess of about 300° F. for any appreciable period of time.

The amount of time that the tobacco blend is subjected to the temperature treatment can vary. The time period should be sufficient to reduce the sucrose ester levels of the Oriental tobacco to the desired level. Typically, the heat treatment period is at least about 10 minutes, preferably at least about 20 minutes. Normally, the time period is less than about 3 hours, preferably less than about 1 hour. In a preferred embodiment, the heat treatment time period is about 20 minutes to about 1 hour.

One method for gauging the appropriate heat treatment time period of a tobacco blend involves measurement of the moisture level of the heat-treated tobacco blend. For example, it is preferable for the tobacco blend to maintain a moisture level of at least about 10 percent by weight throughout the heating process. A final moisture content following heat treatment of about 10 percent to about 20 percent, by weight, is particularly desirable.

The heat treatment preferably occurs at atmospheric pressure using, for example, a vented tank or dryer. It is most convenient and preferable for the process steps to be carried out without taking special care to control the pressure of the atmosphere that surrounds the tobacco material (i.e., the process steps can be carried out under normal atmospheric pressure conditions), and without taking special steps to control the make up of the atmosphere that surrounds the tobacco (i.e., the process steps can be carried out in normal atmospheric air). However, a pressure-controlled environment can be used without departing from the invention. Such an environment is provided, for example, by enclosing the tobacco blend in an air-sealed vessel or chamber. Typically, a pressure-controlled environment is provided using a pressure vessel or chamber capable of withstanding relatively high pressures. Preferred pressure vessels are equipped with an external heating source. Examples of vessels that provide a pressure-controlled environment include a high pressure autoclave from Berghof/America Inc. of Concord, Calif., and Parr Reactor Model Nos. 4522 and 4552 available from The Parr Instrument Co. and described in U.S. Pat. No. 4,882,128 to Hukvari et al. Operation of such exemplary vessels will be apparent to the skilled artisan. See, for example, U.S. Pat. No. 6,048,404 to White. Typical atmospheric pressures experienced by the tobacco blend during such a pressure-controlled heating process conducted in such vessels often range from about 10 psig to about 1,000 psig, normally from about 20 psig to about 500 psig.

Atmospheric air, or ambient atmosphere, is the preferred atmosphere for carrying out the present invention. However, heating moistened tobacco mixtures also can be performed under a controlled atmosphere, such as a generally inert atmosphere. The term "generally inert" is intended to mean that the heat treatment can be performed in an inert gas or under ambient atmosphere. With heat treatment in ambient air, no additional oxygen or equivalent oxidizing agent is necessary. With an inert atmosphere, an atmosphere that is inert, i.e., non-reactive, with respect to the tobacco materials in the blend is employed. Gases such as nitrogen, argon and carbon dioxide can be used. Alternatively, a hydrocarbon gas (e.g., methane, ethane or butane) or a fluorocarbon gas also can provide at least a portion of a controlled atmosphere in certain embodiments, depending on the choice of treatment conditions and tobacco materials.

Tobacco materials processed according to the process steps of the present invention can be used for the manufacture of tobacco products, and most preferably, smoking articles, such as cigarettes. If desired, the treated tobacco blend can be subjected to a reordering treatment to increase the moisture content prior to use in smoking article manufacturing. The amount of the treated tobacco employed per smoking article can vary, and for cigarette typically possesses about 0.6 g to about 1 g per rod of smoking material. Representative tobacco blends, representative cigarette components, and representative cigarettes manufactured therefrom, are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; U.S. patent application Ser. No. 2002/0000235 to Shafer et al.; and PCT WO 02/37990. Those tobacco materials also can be employed for the manufacture of those types of cigarettes that are described in U.S. Pat. No. 4,793,365 to Sensabaugh; U.S. Pat. No. 4,917,128 to Clearman et al.; U.S. Pat. No. 4,947,974 to Brooks et al.; U.S. Pat. No. 4,961,438 to Korte; U.S. Pat. No. 4,920,990 to Lawrence et al.; U.S. Pat. No. 5,033,483 to Clearman et al.; U.S. Pat. No. 5,074,321 to Gentry et al.; U.S. Pat. No. 5,105,835 to Drewett et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,247,949 to Deevi et al.; U.S. Pat. No. 5,551,451 to Riggs et al.; U.S. Pat. No. 5,285,798 to Banerjee et al.; U.S. Pat. No. 5,593,792 to Farrier et al.; U.S. Pat. No. 5,595,577 to Bensalem et al.; U.S. Pat. No. 5,816,263 to Counts et al.; U.S. Pat. No. 5,819,751 to Barnes et al.; U.S. Pat. No. 6,095,153 to Beven et al.; U.S. Pat. No. 6,311,694 to Nichols et al.; and U.S. Pat. No. 6,367,481 to Nichols, et al.; and PCT WO 97/48294 and PCT WO 98/16125. See, also, those types of commercially marketed cigarettes described *Chemical and Biological Studies on New Cigarette Prototypes that Heat Instead of Burn Tobacco*, R. J. Reynolds Tobacco Company Monograph (1988) and *Inhalation Toxicology*, 12:5, p. 1–58 (2000).

The present invention, in another aspect, relates to a method of measuring the sucrose ester level or concentration of a tobacco material, whereby a transesterification mechanism is used to transform the sucrose esters within the tobacco material to known methyl esters. The method involves the steps of extracting the sucrose esters from the tobacco material by contacting the tobacco with a suitable extraction solvent to yield a tobacco extract, transesterifying the sucrose esters from within the tobacco extract to form known corresponding methyl esters, determining (e.g., measuring) the amount of the methyl esters extracted from the tobacco material using the extraction solvent, and determining the concentration of sucrose esters based on the concentration of the methyl esters resulting from the transesterification of the sucrose ester precursor. The transesterification can be accomplished by mixing the tobacco extract with a strong base, such as a methoxide salt (e.g., sodium methoxide). Gas chromatography/selected ion monitoring-mass spectrometry is a preferred method for determining the amount or concentration of methyl ester expressed as a yield per unit mass of tobacco. Determination of methyl ester is carried out by generating a methyl ester concentration calibration curve generated using calibration standards of the known methyl esters at known concentrations.

The fundamental chemistry underlying the analysis method of the invention is based on a strong base mediated transesterification reaction mechanism. Specifically, this conversion relates to the sodium methoxide (i.e., strong base) mediated transesterification of the isobutyrate, 3-methylbutyrate, and 3-methylpentanoate groups known to be covalently bonded to sucrose in Oriental tobacco to their corresponding methyl esters, yielding respectfully, methylisobutyrate, methyl-3-methylbutyrate, and methyl-3-methylpentanoate. In order to quantify the methyl ester concentration of the transesterified tobacco extract, linear calibration curves for the three known methyl esters (i.e., methylisobutyrate, methyl-3-methylbutyrate and methyl-3-methylpentanoate) can be generated using quantitatively prepared calibration standards over a wide concentration range. Thus, the general method of analyzing the sucrose ester content of a tobacco involves forming a tobacco extract using an extraction solvent in which sucrose esters are soluble. A preferred solvent is methylene chloride. To obtain consistent results, it is preferable to mix the tobacco sample and the extraction solvent, agitate the mixture, allow the mixture to stand for a significant period of time (e.g., overnight), and then agitate the mixture again. The extraction mixture preferably then is filtered, and a strong base, such as sodium methoxide or other methoxide salt (e.g., alkali metal or alkaline earth metal salt), is added to the filtrate. The sodium methoxide undergoes reaction with the sucrose esters in the tobacco extract, resulting in transesterification of the carboxylate groups of the sucrose esters to form corresponding methyl esters. Since the resulting methyl ester compounds are known and commercially available, calibration curves can be formed using calibration standards and the concentration of each methyl ester can be calculated using the responses obtained from gas chromatography/selected ion monitoring-mass spectrometry (GC/SIM-MS).

EXPERIMENTAL

The following examples are given to illustrate the invention, but should not be considered in limitation of the invention. As indicated by these experimental results, significant changes in the chemistry of Oriental tobaccos and blends containing Oriental tobaccos have been demonstrated to occur when the tobaccos are processed under relatively mild conditions with the use of water and heat. For example, the sucrose ester content (expressed as their methyl ester equivalents) of the Oriental tobaccos adjusted to approximately 35% moisture was reduced by a factor of 2 by heating the tobacco for 1 hour at 200° F. in a SARGENT Tray Dryer. Sensory evaluations of the smoke of cigarettes manufactured from those blends indicated significant shifts in sensory attributes of these processed tobaccos when compared to the smoke of cigarettes manufactured from the unprocessed counterparts. Thus, changes in the nature of the Oriental tobaccos have been shown to alter the sensory characteristics of cigarettes prepared with the tobaccos processed according to the invention.

Comparative Examples 1–20 illustrate that heating moist Oriental tobaccos alone, without blending the Oriental tobacco with a dissimilar Oriental tobacco or a non-Oriental tobacco, does not result in significant decreases in sucrose ester content. Examples 1–8 illustrate that significant decreases in sucrose ester content result from heating moist tobacco blends comprising an Oriental tobacco and one or more dissimilar Oriental tobaccos or non-Oriental tobaccos. Unless otherwise noted, all parts and percentages are by weight.

COMPARATIVE EXAMPLE 1

An Oriental tobacco, Mavra, was adjusted to 35% moisture and heated at 200° F. in a convection dryer for about 60 minutes. Following treatment, the sucrose ester level, determined as methyl ester equivalents, was 234 ppm. The methyl ester level of the untreated Oriental tobacco (i.e., control) was 278 ppm.

COMPARATIVE EXAMPLE 2

The same as Example 1, except the heat treatment time was about 45 minutes. The methyl ester level of the treated tobacco was 278 ppm.

COMPARATIVE EXAMPLE 3

The same as Example 1, except the heat treatment time was about 30 minutes. The methyl ester level of the treated tobacco was 271 ppm.

COMPARATIVE EXAMPLE 4

The same as Example 1, except the heat treatment time was about 15 minutes. The methyl ester level of the treated tobacco was 266 ppm.

COMPARATIVE EXAMPLE 5

The same as Example 1, except the heat treatment temperature was 250° F. The methyl ester level of the treated tobacco was 230 ppm.

COMPARATIVE EXAMPLE 6

The same as Example 5, except the heat treatment time was about 45 minutes. The methyl ester level of the treated tobacco was 260 ppm.

COMPARATIVE EXAMPLE 7

The same as Example 5, except the heat treatment time was about 30 minutes. The methyl ester level of the treated tobacco was 261 ppm.

COMPARATIVE EXAMPLE 8

The same as Example 5, except the heat treatment time was about 15 minutes. The methyl ester level of the treated tobacco was 289 ppm.

COMPARATIVE EXAMPLE 9

The same as Example 1, except the Oriental tobacco was Izmir. The methyl ester level of the untreated Oriental tobacco (i.e., control) was 2930 ppm. The methyl ester level of the treated tobacco was 2537 ppm.

COMPARATIVE EXAMPLE 10

The same as Example 9, except the heat treatment time was about 45 minutes. The methyl ester level of the treated tobacco was 2732 ppm.

COMPARATIVE EXAMPLE 11

The same as Example 9, except the heat treatment time was about 30 minutes. The methyl ester level of the treated tobacco was 2888 ppm.

COMPARATIVE EXAMPLE 12

The same as Example 9, except the heat treatment time was about 15 minutes. The methyl ester level of the treated tobacco was 2928 ppm.

COMPARATIVE EXAMPLE 13

The same as Example 9, except the heat treatment temperature was 250° F. The methyl ester level of the treated tobacco was 3073 ppm.

COMPARATIVE EXAMPLE 14

The same as Example 13, except the heat treatment time was about 45 minutes. The methyl ester level of the treated tobacco was 2755 ppm.

COMPARATIVE EXAMPLE 15

The same as Example 13, except the heat treatment time was about 30 minutes. The methyl ester level of the treated tobacco was 2973 ppm.

COMPARATIVE EXAMPLE 16

The same as Example 13, except the heat treatment time was about 15 minutes. The methyl ester level of the treated tobacco was 3499 ppm.

COMPARATIVE EXAMPLE 17

The same as Example 1, except the moisture level was adjusted to 16%. The methyl ester level of the treated tobacco was 246 ppm.

COMPARATIVE EXAMPLE 18

The same as Example 17, except the heat treatment temperature was 250° F. The methyl ester level of the treated tobacco was 264 ppm.

COMPARATIVE EXAMPLE 19

The same as Example 9, except the moisture level was adjusted to 16%. The methyl ester level of the treated tobacco was 2603 ppm.

COMPARATIVE EXAMPLE 20

The same as Example 19, except the heat treatment temperature was 250° F. The methyl ester level of the treated tobacco was 3115 ppm.

EXAMPLE 1

A tobacco blend was formed comprising about 50% flue-cured tobacco at 50% moisture, about 27% burley tobacco at 16.5% moisture, and about 23% Oriental tobacco at 14.5% moisture. The blend was adjusted to about 35% moisture and heated at 310° F. in a convection dryer for 5 minutes. Following treatment, the methyl ester level was 750 ppm. The methyl ester level of the untreated tobacco blend (i.e., control) was 1350 ppm. Thus, a blend of non-Oriental tobaccos and an Oriental tobacco having a relatively high sucrose ester content that is subjected to heat treatment at an elevated moisture level for an effective period of time in accordance with the present invention undergoes a significant decrease in sucrose ester content.

EXAMPLE 2

The same as Example 1, except the entire blend was adjusted to 35% moisture at one time. The methyl ester level of the treated tobacco was 750 ppm.

EXAMPLE 3

The same as Example 1, except the heat treatment temperature was 200° F. and the treatment time was about 20 minutes. The methyl ester level of the treated tobacco was 500 ppm.

EXAMPLE 4

The same as Example 3, except the treatment time was about 60 minutes. The methyl ester level of the treated tobacco was 475 ppm.

EXAMPLE 5

An Oriental tobacco blend was formed comprising about 50% Izmir at 16% moisture and about 50% Samsun at 50% moisture. The blend was aged for 24 hours and then heated at 200° F. in a convection dryer for about 60 minutes. Following treatment, the methyl ester level was 3100 ppm. The methyl ester level of the untreated tobacco blend (i.e., control) was 4700 ppm.

EXAMPLE 6

The same as Example 5, except the Izmir moisture level was 50% and the Samsun moisture level was 16%. The methyl ester level of the treated tobacco was 3100 ppm.

EXAMPLE 7

The same as Example 5, except the tobacco blend comprised about 50% Samsun at 50% moisture and about 50% flue-cured tobacco at 16% moisture. Following treatment, the methyl ester level was 950 ppm. The methyl ester level of the untreated tobacco blend (i.e., control) was 3200 ppm.

EXAMPLE 8

The same as Example 7, except the moisture level of the Samsun was 16% and the moisture level of the flue-cured was 50%. The methyl ester level of the treated tobacco was 1600 ppm.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method of reducing the sucrose ester concentration of a tobacco mixture comprising a first Oriental tobacco having a relatively high sucrose ester concentration, the method comprising:

contacting a first Oriental tobacco having a sucrose ester concentration of at least about 1,600 ppm with (i) a second dissimilar Oriental tobacco having a lower sucrose ester concentration than the first Oriental tobacco, (ii) a non-Oriental tobacco having a lower sucrose ester concentration than the first Oriental tobacco, or (iii) a combination thereof, to form a tobacco mixture having a first total sucrose ester concentration, wherein the tobacco mixture comprises at least about 10 percent by weight of the first Oriental tobacco, based on the total weight of tobacco in the mixture;

heating the tobacco mixture for a time and under conditions sufficient to reduce the concentration of sucrose esters in the tobacco mixture to a second total sucrose ester concentration lower than said first total sucrose ester concentration; and incorporating the heat-treated tobacco mixture into a smoking article.

2. A method according to claim 1, wherein the tobacco mixture comprises a non-Oriental tobacco selected from the group consisting of flue-cured tobacco, burley tobacco, and mixtures thereof.

3. A method according to claim 1, wherein the tobacco mixture comprises a second dissimilar Oriental tobacco and at least one non-Oriental tobacco selected from the group consisting of flue-cured tobacco, burley tobacco, and mixtures thereof.

4. A method according to claim 1, wherein, prior to heating, the first Oriental tobacco has a sucrose ester concentration of at least about 2,000 ppm.

5. A method according to claim 1, wherein, prior to heating, the first Oriental tobacco has a sucrose ester concentration of at least about 3,000 ppm.

6. A method according to claim 1, wherein, prior to heating, the first Oriental tobacco has a sucrose ester concentration of at least about 4,000 ppm.

7. A method according to claim 1, wherein, prior to heating, the first Oriental tobacco has a sucrose ester concentration of at least about 5,000 ppm.

8. A method according to claim 1, wherein, following heating, the first Oriental tobacco has a sucrose ester concentration below about 1,500 ppm.

9. A method according to claim 1, wherein, following heating, the first Oriental tobacco has a sucrose ester concentration below about 1,200 ppm.

10. A method according to claim 1, whereby the heating provides a sucrose ester reduction in the first Oriental tobacco of at least about 20% by weight.

11. A method according to claim 1, whereby the heating provides a sucrose ester reduction in the first Oriental tobacco of at least about 30% by weight.

12. A method according to claim 1, wherein the heating involves applying heat to raise the tobacco mixture to a temperature of about 200° F. to about 310° F.

13. A method according to claim 1, wherein the heating involves applying heat to raise the tobacco mixture to a temperature of about 200° F. to about 250° F.

14. A method according to claim 1, wherein the heating is conducted in atmospheric air and under atmospheric pressure.

15. A method according to claim 1, wherein the heating involves applying heat to the tobacco mixture for at least about 10 minutes.

16. A method according to claim 1, wherein the heating involves applying heat to the tobacco mixture for about 10 minutes to about 1 hour.

17. A method according to claim 1, wherein the heating involves applying heat to the tobacco mixture until the moisture content of the tobacco mixture is reduced to between about 10% and about 20% by weight.

18. A method according to claim 1, wherein the tobacco mixture comprises about 10 to about 30 weight % Oriental tobacco, based on the total weight of tobacco in the mixture.

19. A method according to claim 1, wherein, prior to heating, the tobacco mixture has a moisture content of at least about 15% by weight.

20. A method according to claim 1, wherein, prior to heating, the tobacco mixture has a moisture content of at least about 20% by weight.

21. A method according to claim 1, wherein, prior to heating, the tobacco mixture has a moisture content of about 15% to about 50% by weight.

22. A method according to claim 1, wherein each tobacco component of the tobacco mixture have a moisture content of about 15% to about 50% by weight prior to contact with one another.

23. A method according to claim 1, wherein the smoking article is a cigarette.

24. A smoking article comprising a heat-treated tobacco mixture prepared according to the method of claim 1.

25. A method of reducing the sucrose ester concentration of a tobacco mixture comprising a first Oriental tobacco having a relatively high sucrose ester concentration, the method comprising:

forming a tobacco mixture having a moisture content of at least about 20% by weight and comprising (i) about 10 to about 30 weight percent of an Oriental tobacco having a sucrose ester concentration of at least about 1,600 ppm) (ii) about 35 to about 50 weight percent of flue-cured tobacco, and (iii) about 10 to about 50 weight percent of burley tobacco, based on the total weight of the tobacco in the mixture;

heating the tobacco mixture at a temperature of at least about 200° F. for a time sufficient to reduce the concentration of sucrose esters in the Oriental tobacco to below about 1,500 ppm; and incorporating the heat-treated tobacco mixture into a smoking article.

26. A method according to claim 25, wherein the smoking article is a cigarette.

27. A smoking article comprising a heat-treated tobacco mixture prepared according to the method of claim 25.

* * * * *

UNITED STATES PATENT AND TRADEMARK OFFICE

CERTIFICATE OF CORRECTION

PATENT NO. : 7,025,066 B2
APPLICATION NO. : 10/285395
DATED : April 11, 2006
INVENTOR(S) : Lawson et al.

It is certified that error appears in the above-identified patent and that said Letters Patent is hereby corrected as shown below:

Column 4,

Line 19, "Wiemik" should read --Wiernik--.

Signed and Sealed this

Twenty-eighth Day of November, 2006

JON W. DUDAS
*Director of the United States Patent and Trademark Office*